United States Patent [19]

Gratzl

[11] Patent Number: 4,826,567

[45] **Date of Patent: * May 2, 1989**

[54] PROCESS FOR THE DELIGNIFICATION OF CELLULOSIC SUBSTANCES BY PRETREATING WITH A COMPLEXING AGENT FOLLOWED BY HYDROGEN PEROXIDE

[75] Inventor: Josef S. Gratzl, Cary, N.C.

[73] Assignee: Interox (Société Anonyme), Brussels, Belgium

[ * ] Notice: The portion of the term of this patent subsequent to May 2, 2006 has been disclaimed.

[21] Appl. No.: 34,501

[22] Filed: Mar. 27, 1987

Related U.S. Application Data

[63] Continuation of Ser. No. 762,726, Aug. 5, 1985, abandoned.

[51] Int. Cl.[4] ..... D21C 1/04; D21C 1/08; D21C 3/02

[52] U.S. Cl. ..... 162/72; 162/76; 162/78

[58] Field of Search ..... 162/76, 78, 65, 90, 162/84, 19, 60

[56] References Cited

U.S. PATENT DOCUMENTS 4,050,981 9/1977 Jamieson et al. ..... 162/65
4,462,864 7/1984 Carles ..... 162/70

FOREIGN PATENT DOCUMENTS 8091884 5/1983 Japan ..... 162/78

OTHER PUBLICATIONS

Rydholm "Pulping Processes" pp. 662–672 Interscience Publishers, N.Y. 1967.
Sven A. Rydholm, *Pulping Processes,* pp. 648 to 673 (1965).

*Primary Examiner*—Steve Alvo
*Attorney, Agent, or Firm*—Spencer & Frank

[57] ABSTRACT

Process for the delignification of cellulosic substances comprising:

- a first stage of treatment of cellulosic substances with an acid
- a second stage of treatment with hydrogen peroxide in an alkaline medium
- a third stage of digestion in the presence of at least one chemical reactant chosen from hydroxides of alkaline or alkaline-earth metals.

The process applies to the treatment of wood fragments.

1 Claim, No Drawings

PROCESS FOR THE DELIGNIFICATION OF CELLULOSIC SUBSTANCES BY PRETREATING WITH A COMPLEXING AGENT FOLLOWED BY HYDROGEN PEROXIDE

This application is a continuation, of application Ser. No. 06/762,726, filed Aug. 5, 1985, now abandoned.

The present invention relates to a process for the delignification of lignocellulosic substances with a view to the preparation of pulps intended for paper manufacture. It relates more specifically to the field of chemical pulps produced by digesting cellulosic substances in the presence of chemical reactants endowed with delignifying properties.

It is well know that most of the conventional processes used up till now for pulping suffer the drawbacks of rejecting a high amount of pollutants into the environment.

Attempts have been made for a long time to increase the efficiency of some non polluting processes for the digestion of cellulosic substances in order to bring it to the level of kraft digestions.

In connection with this, it has been suggested to subject cellulosic substances, before their digestion, to an impregnation with a solution containing a peroxide compound.

Belgian patent No. BE-A-678,022 (Degussa) relates to a process in which the pretreatment of the cellulosic substances with the aqueous solution of the peroxide compound is carried out in a strongly alkaline medium before their digestion using a chemical reactant. This patent teaches that, when this technique is applied, the subsequent chemical digestion process is facilitated, while the weight yield of pulp is maintained (page 3, last paragraph and page 4, lines 1 to 13).

In the manuscripts from the EUCEPA Symposium "The Delignification Methods of The Future", Vol. II, No. 7–18 Helsinki, 2 to 5 June 1980, it is disclosed (Pekkala, pages 14/1 to 14/19) that the pretreatment of chips with alkaline hydrogen peroxide accelerated delignification in the soda cook to the level of kraft pulping but also caused a severe loss in carbohydrate yield (page 14/7, lines 10 to 12).

Furthermore, all these known processes have the disadvantage of producing pulps which are more degraded, that is to say with lower viscosity, and the weight yield of which is generally lower, compared to the viscosities and to the yields of the conventional chemical pulps with an equivalent degree of delignification.

The invention overcomes these disadvantages of the known processes, by providing a new process for the delignification of cellulosic substances, which makes it possible to attain high degrees of delignification while retaining the intrinsic quality of the cellulose and the weight yield of pulp produced.

To this end, the invention relates to a process for the delignification of cellulosic substances according to which, in a first stage, cellulosic substances are treated with an acid, in a second stage the cellulosic substances from the first stage are treated with hydrogen peroxide in an alkaline medium and, in a third stage, the cellulosic substances from the second stage are subjected to an alkaline digestion in the presence of at least one chemical reactant chosen from hydroxides of alkaline or alkaline-earth metals.

According to the invention, the term "cellulosic substances" is intended to refer to fragments of ligneceous plants employed as raw materials in the papermaking industry. Examples of such materials are fragments of wood, of annual herbaceous plants such as alfa-alfa, of plants of the class of monocotyledons class such as the straws of cereals, bamboo, esparto, rushes and reeds, as well as sugar cane, in particular its residue, bagasse, after sugar has been extracted. The invention applies more particularly to wood fragments. All types of resinous woods (softwoods) or deciduous woods (hardwoods) which can be employed in the papermaking industry are suitable for the process according to the invention. Resinous wood chips and sawmill wastes are particularly suitable.

In the process according to the invention, the treatment with an acid is intended to decontaminate the cellulosic substances from the metals which they generally contain. Any inorganic or organic acids employed in aqueous solution, alone or in a mixture, are suitable. Strong inorganic acids such as sulphuric acid or hydrochloric acid are suitable. It is suitable that the first stage be carried out in the presence of a complexing agent for metal ions. To this end, mixtures acids from the group of aminopolycarboxylic or aminopolyphosphonic acids or their salts of alkaline metals, which have sequestering properties in respect of metal ions, are particularly suitable. Diethylenetriaminepentaacetic acid (DTPA) is preferred. Examples of suitable aminopolycarboxylic acids are diethylenetriaminepentaacetic acid, ethylenediaminetetraacetic acid, cyclohexanediaminetetraacetic acid and nitrilotriacetic acid. Examples of aminopolyphosphonic acids are diethylenetriaminepentamethylenephosphonic acid, ethylenediaminetetra(methylenephosphonic) acid and nitrolotri(methylenephosphonic acid. Diethylenetriaminepentamethylenephosphonic acid (DTMPA) is preferred.

The operating conditions in the first stage of the process according to the invention are not critical. They should be determined in each individual case as a function of the type of cellulosic substances and of the equipment in which the treatment is being carried out. In general, the choice of the acid and the quantity employed should be fixed so that the medium is at a pH below 7, for example between 0.5 and 6.5; pH values which are particularly advantageous are those between 1.0 and 4.0.

The temperature and pressure are not critical, ambient temperature and atmospheric pressure being generally suitable. The length of the treatment may vary within wide limits depending on the type of equipment employed, the choice of acid, the temperature and the pressure, for example from 30 minutes to several hours when the treatment is carried out by soaking the cellulosic substances in a chest, and from 1 to 120 minutes when it is carried out by percolation in a column in which the cellulosic substances to be treated are stacked.

In an alternative embodiment of the process according to the invention, the cellulosic substances may be subjected to a steam treatment before the first stage. The aim of this treatment is to facilitate the impregnation operations which will follow.

The role of the hydrogen peroxide employed in the second stage of the process according to the invention is to accelerate the delignification of the cellulosic substances and to retard carbohydrate degradation in the digestion stage which follows. The optimum quantity of hydrogen peroxide to be employed depends on the source of the cellulosic substances. In general, more than 0.1 g of hydrogen peroxide must be employed per 100 g of dry cellulosic substance. Quantities of hydrogen peroxide which are greater than 3 g/100 g of dry cellulosic substance are seldom necessary to produce rapid delignification. Usually, use is made of hydrogen peroxide proportions of between 0.5 and 2 g/100 g of dry substance. Peroxide proportions of between 0.7 and 1.5 g/100 g of dry substance have given the best results.

The hydrogen peroxide employed may be anhydrous hydrogen peroxide or, preferably, an aqueous solution, for example a commercial aqueous solution of hydrogen peroxide the weight concentration of which is between 25 and 90 g of pure hydrogen peroxide per 100 g of solution or an aqueous diluted alkaline solution of hydrogen peroxide obtained by electrochemical reduction of oxygen.

In the process according to the invention, the treatment of cellulosic substances with alkaline hydrogen peroxide may be carried out in the presence of additives such as, for example, stabilizers and inhibitors of the decomposition of hydrogen peroxide. Such additives are, for example, inorganic or organic sequestering agents for metal ions, such as magnesium salts, aminopolycarboxylic acids or sodium silicate of water glass quality. Other additives which can also be employed are surface-active agents, wetting agents, agents capable of protecting the cellulose chains to prevent their depolymerisation, activating agents or anticorrosion agents. The quantity of additive introduced is generally never greater than 1% of the weight of cellulosic substances. In most cases it is between 0 and 0.5% of the weight of these substances.

In the second stage of the process according to the invention, the alkaline medium is produced by the addition of soluble substances of a basic nature. Ammonia, inorganic carbonates and hydroxides of alkali or alkaline-earth metals, such as sodium, potassium or calcium carbonate, and sodium, potassium or calcium hydroxide are generally employed. Alkali or alkalineearth metal oxides or peroxides, such as $Na_2O$, $Na_2O_2$, CaO and $CaO_2$, may also be suitable and, in the case of the peroxides, may replace the addition of a part of the hydrogen peroxide introduced in the second stage of the process. Sodium hydroxide is usually preferred on account of its ready availability and its low cost. The quantities of basic substance to be employed are chosen so as to adjust the pH of the peroxide solution between 11 and 13.5, and preferably between 12 and 13.

The operating conditions for the second stage of the process according to the invention may also vary within fairly wide limits depending, particularly, on the type of cellulosic substances and the type of equipment employed. The pressure prevailing during the second stage may thus be in the range from 2 kPa to 10 Mpa, and the temperature in the range from 290° K. to 380° K. The treatment with hydrogen peroxide in an alkaline medium in the second stage is generally carried out for a time longer than 2 minutes and not exceeding 180 minutes.

In a particular embodiment of the invention, the cellulosic substances to be treated are subjected to alkaline hydrogen peroxide in a liquor to wood weight ratio not exceeding 2.5:1, preferably ranging from 1:1 to 2:1. In this preferred embodiment, the cellulosic substances originating from the first stage are impregnated in a closed reactor with the preheated alkaline hydrogen peroxide liquor, and then the excess liquor which has not impregnated the cellulosic substances is drained from the reactor which is then heated to reaction temperature.

In this preferred embodiment, soaking of the cellulosic substances in hydrogen peroxide liquor, before the reaction, generally requires not more than 5 minutes. However, it cannot usually be carried out in less than 30 seconds. The temperature of the peroxide liquor is in most cases chosen 5° to 20° K. higher than that prevailing in the reactor, which is maintained for 15 to 120 minutes by means of the heating jacket. A reaction temperature of between 310° and 360° K. is suitable. The best results have been obtained at a temperature of 323° K. and with a reaction time of 45 minutes.

The third stage of the process according to the invention consists in subjecting the cellulosic substances originating from the second stage to an alkaline digestion in the presence of at least one chemical reactant. The term "chemical reactants" should be understood to mean the hydroxides of alkaline and alkaline-earth metals. Advantageous examples of such chemical reactants are sodium hydroxide and calcium hydroxide.

Some well known delignifying additives may be added in the third stage of the process according to the invention. These additives are generally used to increase the delignification during the alkaline digestion. Organic compounds are preferred, such as for example: anthraquinone and its derivatives such as 1-methylanthraquinone, 2-methylanthraquinone, 2-ethylanthraquinone, 2-methoxyanthraquinone, 2,3-dimethylanthraquinone, 2,7-dimethylanthraquinone, 1,4,4a,5,8,8a, 9a,10a-octahydroanthraquinone and 1,4,4a,9a-tetrahydroanthraquinone; hydroquinones like p-hydroquinone; some derivatives of anthracene like 9-nitroanthracene, 9,10-dinitroanthracene and 9-nitro-10-chloro-9,10-dihydroanthracene; some heterocyclic compounds like 6,11-dioxo-1H-anthra [2-c] pyrazole; polynuclear compounds like 1,2-benzanthraquinone and phenantrenequinone; nitrobenzene; amines such as monoethanolamine and ethylenediamine; alcohols such as resorcinol and pyrogallol. Examples of inorganic compounds are hydrazine and borohydride of alkaline metals. Anthraquinone and its derivatives are the most efficient additives. Anthraquinone is preferred. These additives are advantageously used in quantities not exceeding 2% of the weight of the dry cellulosic substances. Generally their quantity is kept below 1% of that weight.

The optimum operating conditions for the third stage of the process according to the invention depend on various parameters, particularly on the source of the cellulosic substances and they may be readily determined in each individual case.

In a preferred embodiment of the process according to the invention, washing of the cellulosic substances with water is carried out between the second and the third stage. Said embodiment is advantageous when additives comprising reducing substances are added to the third stage. This washing is intended to eliminate from the cellulosic substances at least a part of the water-soluble materials produced during the second stage, and to extract the last traces of hydrogen peroxide which are still present, to avoid unnecessary oxidation of the reducing substances.

The process according to the invention makes it possible to accelerate markedly the delignification of the cellulosic substances which are treated, resulting in a shortening of the time required for the third stage of digestion with chemical reactants. This results in the major advantage of an appreciable reduction in the size of the digestion equipment, resulting in savings of space and lower capital cost or, alternatively of an increased throughput with a given digestion equipment.

The invention also permits, at an equal degree of delignification, an appreciable reduction in the quantity of the chemical reactants in the digestion stage leading to a substantial saving in chemical reactants.

Finally, the invention also produces, in better weight yields and consequently at a lower cost, chemical pulps with higher viscosities than those produced by the processes of the prior art.

I claim:

1. A process for delignifying cellulosic substances, comprising the following steps in the order stated:

treating cellulosic substances to remove metal ions in a first stage with an aqueous solution of mixtures of an aqueous acid with a complexing agent of metal ions to attain a final pH between about 1 and 4 under conditions effective for removing metal ions from the cellulosic substances, mixing said cellulosic substances from which metal ions have been removed in a second stage with between about 0.1 g and 3 g of hydrogen peroxide per 100 g of dry cellulosic substance and adjusting the pH of the solution to between about 12 and 13 at a temperature between about 290° K. and 380° K. and a pressure between about 2 kPa and 10 MPa for a period of time between about 2 minutes and 180 minutes to accelerate delignification of said cellulosic substances and retard carbohydrate degradation during subsequent digestion, and subjecting the thus treated cellulosic materials in a third stage to an alkaline digestion in the presence of at least one delignifying agent selected from the group consisting of anthraquinone and derivatives thereof, hydroquinones, pyrazoles, benzanthraquinone, phenanthrenequinone, nitrobenzene, amines, alcohols, hydrazine, and alkaline earth metal borohydride under conditions effective to attain delignification while minimizing carbohydrate degradation.

* * * * *